US005654865A

United States Patent [19]

Ryan

[11] Patent Number: 5,654,865

[45] Date of Patent: Aug. 5, 1997

[54] POWER AND CONTROL CIRCUIT FOR AN ELECTRIC DOOR STRIKE

[75] Inventor: Shevlin E. Ryan, Scottsdale, Ariz.

[73] Assignee: Hanchett Entry Systems, Inc., Phoenix, Ariz.

[21] Appl. No.: 520,125

[22] Filed: Aug. 28, 1995

[51] Int. Cl.[6] ..... H01H 9/00

[52] U.S. Cl. ..... 361/154; 361/194; 361/195; 361/160

[58] Field of Search ..... 361/155, 143, 361/154, 195, 160, 139, 194

[56] References Cited

U.S. PATENT DOCUMENTS

| | | | |
|---|---|---|---|
| 4,537,049 | 8/1985 | Lupoli | 70/277 |
| 4,716,490 | 12/1987 | Alexanian | 361/155 |
| 4,721,954 | 1/1988 | Mauch | 340/825.31 |
| 4,899,271 | 2/1990 | Seiersen | 363/126 |
| 5,003,290 | 3/1991 | Lindquist et al. | 340/545 |
| 5,161,083 | 11/1992 | Mohler et al. | 361/143 |
| 5,416,472 | 5/1995 | Torii, Jr. | 340/825.32 |
| 5,490,699 | 2/1996 | Uyeda | 292/341.16 |

*Primary Examiner*—Jeffrey A. Gaffin
*Assistant Examiner*—Jason L. W. Kost
*Attorney, Agent, or Firm*—Warren F. B. Lindsley

[57] ABSTRACT

This invention discloses a versatile power and control circuit for an electric door strike that is operable in four different modes with readily adjustable release times. In addition, the invention is directed toward the provision of a highly efficient power supply that permits miniaturization and prevents overheating in the confined space that is available for installation in a door jamb.

10 Claims, 3 Drawing Sheets

MC34060A
OSC.
REF. REG.
DEAD TIME COMP
PWM COMP
ERR AMP1
ERR AMP2
DEAD TIME CONTR.
GND
+5V
VCC
V4
VSOL (TO SOLENOID)
VIN
VS
BRI
S3
S2
S1
Q1
Q2
L1
CR1
CR2
CR3
V3
V5
V2
V1
555 U1
555 U2
OUT
Tr
R
RT3 6.8K
CT3 .01
R7 4.7K
R6 360K
C5 .01
R4B 2.7K
R4A 4.7K
R18 47K
C15 .01 µf
RT2
CT2 4.7
R17 47K
C11 .01
R3 6.8K
R19 1M
C4 .01
R5 13K
R11 100K
R13 100K
R9 100K
R10 100K
R12 100K
R1 1K
R2 510Ω
C1 330µf
RT1
CT1 4.7µf
R16 100K
R14 100K
R15 47K
C8 .01
C7 .1
2V
.7V

| | VOLTS (V) OR STATE | | |
|---|---|---|---|
| U1 OUT (V1) | 0V | +5V | 0V |
| U2 OUT (V2) | 0V | 0V | 0V |
| ERR AMP2 (+) | 0V | +1.7V | 0V |
| ERR AMP 2 (−) | 0V | +5V | 0V |
| V3 | 0V | LOW | 0V |
| V4 | 0V | CONTROLLED BY ERR AMP 1 | 0V |
| Q1 | OFF | " " | OFF |
| Q2 | OFF | " " | OFF |
| V5 | 0V | " " | 0V |
| $V_{SOL}$ | 0V | FULL VOLTAGE | 0V |
| STRIKE | LOCKED | UNLOCKED | LOCKED |

S3 CLOSED

S3 RELEASED

FAIL SECURE/ DIRECT CONTROL

FIG. 2

| | VOLTS (V) OR STATE | | |
|---|---|---|---|
| U1 OUT (V1) | 0V | +5V | 0V |
| U2 OUT (V2) | 0V | 0V | 0V |
| ERR AMP 2 (+) | +3.1V | +1.7V | +3.1V |
| ERR AMP 2 (−) | +2.5V | +5V | +2.5V |
| V3 | HIGH | LOW | HIGH |
| V4 | LOW | CONTROLLED BY ERR AMP 1 | LOW |
| Q1 | OFF | " " | OFF |
| Q2 | OFF | " " | OFF |
| V5 | +3.7V | +5V | +3.7V |
| $V_{SOL}$ | 0V | FULL VOLTAGE | 0V |
| STRIKE | LOCKED | UNLOCKED | LOCKED |

to

S1 DEPRESSED

U1 TIME-OUT COMPLETED

FAIL SECURE/ TIMED RELEASE

FIG. 3

| | VOLTS (V) OR STATE | | | |
|---|---|---|---|---|
| U1 OUT (V1) | 0V | 0V | +5V | 0V |
| U2 OUT (V2) | 0V | 0V | 0V | 0V |
| ERR AMP 2(+) | +1.7V | 0V | +1.7V | +1.7V |
| ERR AMP2 (−) | +2.5V | 0V | +5V | +2.5V |
| V3 | LOW | 0V | LOW | LOW |
| V4 | CONTROLLED BY ERR AMP 1 | 0V | CONTROLLED BY ERR AMP 1 | CONTROLLED BY ERR AMP 1 |
| Q1 | " " | OFF | " " | " " |
| Q2 | " " | OFF | " " | " " |
| V5 | +3.75V | 0V | +5V | +3.75V |
| $V_{SOL}$ | HOLDING VOLTAGE | 0V | FULL VOLTAGE | HOLDING VOLTAGE |
| STRIKE | LOCKED | UNLOCKED | LOCKED | LOCKED |

to — S3 OPENED — S3 CLOSED — U1 TIMED OUT — FAIL SAFE/ DIRECT CONTROL

FIG. 4

| | VOLTS (V) OR STATE | | | |
|---|---|---|---|---|
| U1 OUT (V1) | 0V | 0V | +5V | 0V |
| U2 OUT (V2) | 0V | +5V | 0V | 0V |
| ERR AMP 2 (+) | +1.7V | +3.3V | +1.7V | +1.7V |
| ERR AMP 2 (−) | +2.5V | +2.5V | +5V | +2.5V |
| V3 | LOW | HIGH | LOW | LOW |
| V4 | CONTROLLED BY ERR AMP 1 | LOW | CONTROLLED BY ERR AMP 1 | CONTROLLED BY ERR AMP 1 |
| Q1 | " " | OFF | " " | " " |
| Q2 | " " | OFF | " " | " " |
| V5 | +3.75V | +3.75V | +5V | +3.75V |
| $V_{SOL}$ | HOLDING VOLTAGE | 0V | FULL VOLTAGE | HOLDING VOLTAGE |
| STRIKE | LOCKED | UNLOCKED | LOCKED | LOCKED |

to — S2 DEPRESSED — U2 TIME-OUT COMPLETED — U1 TIME-OUT COMPLETED — FAIL SAFE/ TIMED RELEASE

FIG. 5

POWER AND CONTROL CIRCUIT FOR AN ELECTRIC DOOR STRIKE

BACKGROUND OF THE INVENTION

Electric door strikes are commonly used in various places of business where it is desired to control entry into a secured area by means of a remote switch. As an example, the lobby of a building might be separated from the rest of the facility by a door that is secured by an electric door strike. When an individual or group of individuals has been cleared for entry into the main part of the building, the receptionist or security guard depresses a momentary switch causing the door strike to be unlocked for a set period of time. The door strike then returns automatically to the locked condition.

There are four general versions or operating modes of the electric door strike, commonly referenced as follows:

Fail Secure/Direct Control

Fail Secure/Timed Release

Fail Safe/Direct Control

Fail Safe/Timed Release

In the Fail Secure mode, a loss of power leaves the door strike in the locked condition. The solenoid that drives the strike may be powered only briefly to unlock the door, and, because of the low duty cycle, the average power demand is low. In certain applications (i.e. employer entrance doors) the fail secure strike may be powered for eight or more hours. Reducing the voltage to a "hold-in level" after initial pull in is useful here also.

In the Fail Safe mode, the door strike is unlocked by a loss of power. Fail Safe strikes are powered continuously except while the door is unlocked. This constitutes a high duty cycle with relatively high average power demands. To prevent overheating in this operating mode, the voltage supplied to the solenoid should be reduced to a holding voltage after pull-in.

Under Direct Control, the strike is held in an unlocked condition as long as the switch is depressed. When the switch is released, the strike returns to the locked condition. Depressing the switch removes power to unlock for Fail Safe and applies power to unlock for Fail Secure.

In the Fail Secure/Timed Release mode or the Fail Safe/Timed Release mode, the doorstrike remains unlocked for a set period of time following a momentary switch closure. Again, power is removed to unlock under Fail Secure and is applied to unlock under Fail Safe.

The installers of electric door strikes are constantly confronted by a number of complications that arise because of the variety of operating modes. In addition, there is a lack of standardization in the industry relative to supply voltage for strike operation. Some strikes are designed to operate at 12, or 24 or up to 40 volts dc; others are designed for 12, 16 or 24 volts ac. Supply voltage from 12 to 40 volts dc or 12 to 28 volts ac may be present at a particular location, and the installer needs to match the device to the available voltage. One customer may require a relatively short release time; another may want a considerably longer release time. Because of the limited versatility and adjustability of prior art and presently available electric door strikes, the installer is required to stock a supply of the various versions of door strikes, and in some cases complicated adjustments have to be made at the site.

The goal of the present invention is to provide a versatile power and control circuit for an electric door strike that is immediately operable from any of the aforementioned voltage sources and is readily adaptable at the site for operation in any of the four different modes with readily adjustable release times. In addition, the present invention is directed toward the provision of a highly efficient power supply that permits miniaturization and prevents overheating in the confined space that is available for installation in the door jamb. The unit also minimizes heating of the door strike by reducing operating voltage to a hold-in level after initial powering.

SUMMARY OF THE INVENTION

In accordance with the invention claimed, a versatile, adaptable, adjustable and highly efficient power and control circuit is provided for an electric door strike.

It is, therefore, one object of this invention to provide an improved power and control circuit for an electric door strike.

Another object of this invention is to incorporate in such a power and control circuit the versatility and adaptability required for operation in any of the four common operating modes, namely Fail Secure/Direct Control, Fail Secure/Timed Release, Fail Safe/Direct Control and Fail Safe/Timed Release.

A further object of this invention is to provide in such a power and control circuit simple and convenient means for adjustment of release times over the expected range of customer requirements.

A still further object of this invention is to provide in such a power and control circuit a capability for operation from a variety of voltage or power sources including 12 to 40 volts dc and 12 to 28 volts Yet another object of this invention is to provide such a power and control circuit in a highly efficient form that permits miniaturization and operation in the very confined quarters available in an ordinary door jamb.

A still further object of this invention is to reduce heating of the control circuit of an electric door strike by switching to a hold-in voltage.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described by reference to the accompanying drawings in which:

FIG. 2 shows successive voltages or states of various elements of the power and control circuit through a complete cycle of operation for the Fail Secure/Direct Control operating mode;

FIG. 3 shows successive voltages or states of various elements of the power and control circuit through a complete cycle of operation for the Fail Secure/Timed Release operating mode;

FIG. 4 shows successive voltages or states of various elements of the power and control circuit through a complete cycle of operation for the Fail Safe/Direct Control operating mode; and FIG. 5 shows successive voltages or states of various elements of the power and control circuit through a complete cycle of operation for the Fail Safe/Timed Release operating mode.

DESCRIPTION OF THE PREFERRED EMBODIMENT

Figure 1:
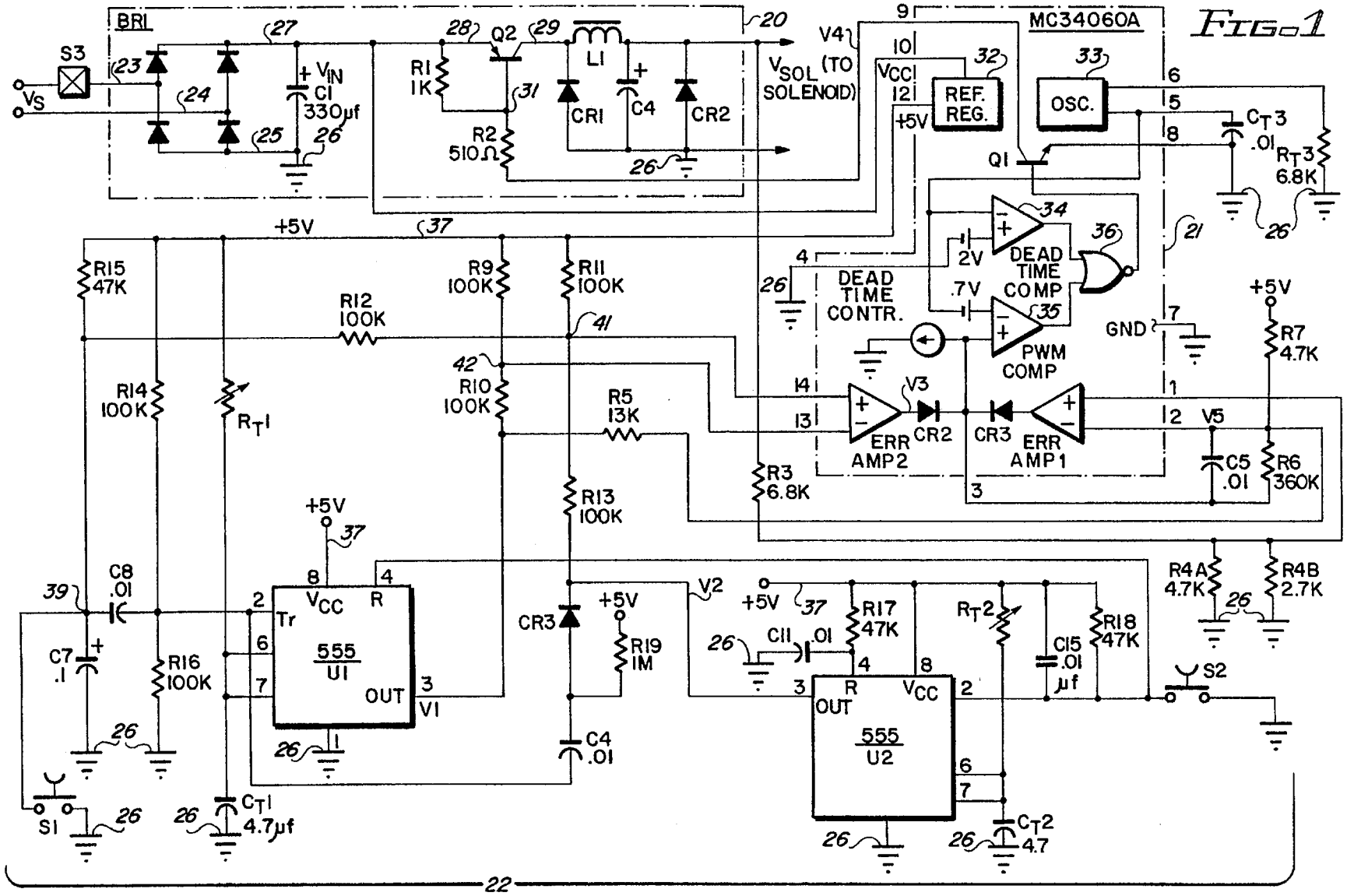
FIG. 1 is a schematic drawing of the power and control circuit of the invention.

Referring more particularly to the drawings by characters of reference, FIG. 1 discloses the electric door strike power and control circuit of the invention. The circuit comprises a power stage 20, a pulse width modulator (PWM) 21 and an operational control circuit 22 comprising first and second timers U1 and U2, and associated resistors and capacitors.

Power stage 20 comprises a bridge rectifier BR1, a PNP transistor Q2, an LC filter, L1 and C4, a filter capacitor C1, a recovery diode CR1, Q2 base-emitter resistor R1, Q2 base resistor R2, and solenoid recovery diode CR2.

The ac terminals 23 and 24 of bridge rectifier BR1 are connected to the ac or dc power source Vs, either directly (for Timed Release modes) or through a switch S3 (for Direct Control modes). The negative dc terminal 25 of bridge BR1 is connected to circuit ground 26 and the positive dc terminal 27 of BR1 is connected to the emitter 28 of Q2. Filter capacitor C1 is connected across the positive and negative terminals of bridge rectifier BR1 to provide a low ac impedance for the pulsed dc currents that are drawn from the power source as Q2 is turned ON and OFF by pulse width modulator 21. Filter capacitor C1 also filters the full-wave rectified voltage from bridge BR1. The collector 29 of Q2 is connected to the cathode of CR1 and to one end of L1. The other end of L1 is connected to the positive terminal of capacitor C4. The anode of CR1 and the negative terminal of C4 are connected to circuit ground 26. The base 31 of Q2 is connected to output terminal, pin 9 of PWM 31 by 510 ohm base resistor R2. A 1 K base-emitter resistor R1 is connected from base 31 to emitter 28 of Q2.

Pulse-width modulator U3 may be an integrated circuit of the type described as an MC34060A in the 4th Edition of Motorola's *Linear/Switchmode Voltage Regulator Handbook* (© Motorola Inc., 1989, P.O. Box 20912; Phoenix, Ariz. 85036).

Application information and specifications for the MC34060A are given on pages 443–453 of the above reference handbook where the circuit is described as follows:

The MC34060A is a fixed-frequency pulse width modulation control circuit, incorporating the primary building blocks required for the control of a switching power supply. . . . An internal-linear sawtooth oscillator is frequency-programmable by two external components, $R_T$ and $C_T$. The approximate oscillator frequency is determined by:

$$fosc \cong \frac{1 \cdot 2}{R_T \cdot C_T}$$

Output pulse width modulation is accomplished by comparison of the positive sawtooth waveform across capacitor $C_T$ to either of two control signals. The output is enabled only during that portion of time when the sawtooth voltage is greater than the control signals. Therefore, an increase in control-signal amplitude causes a corresponding linear decrease of output pulse width.

In the ordinary use of the pulse width modulator as a control circuit for a switching power supply, the pulse width modulator pulses the pass transistor ON and OFF at a fixed frequency and continuously adjusts the duty cycle (ratio of ON time to OFF time) as needed to regulate the output voltage to a fixed level.

In the case of the present invention, Q2 is the pass transistor. The pulsed dc voltage delivered by Q2 is filtered by L1 and C4. As Q2 is turned OFF, the energy stored in L1 tends to sustain the current through L1, and recovery diode CR1 provides a path for inductor current during the OFF time of Q2.

To facilitate a clearer understanding of the control exercised by operational control circuit 22 over pulse width modulator 21, details of the internal circuits of the pulse width modulator are shown in FIG. 1. The following features are incorporated.

1. A reference regulator (REF REG) 32 that supplies a precise +5 volts as a reference for the switching regulator;
2. A saw-tooth oscillator, (OSC) 33 with its frequency determined by external resistor $R_T$ and capacitor $C_T$;
3. A dead time comparator (DEAD TIME COMP) 34 which limits the maximum duty cycle of the switching regulator;
4. A pulse width modulator comparator, (PWM COMP) 35 which compares the output of an error amplifier with the output of the sawtooth oscillator, its output going high when the error amplifier output exceeds the instant voltage level of the sawtooth waveform;
5. Two error amplifiers, each driving the positive input of PWM COMP 35 through a diode OR gate (CR2, CR3) the first error amplifier being designated ERR AMP1 and the second, ERR AMP 2;
6. A NOR gate 36 with two input terminals, one connected to the output of DEAD TIME COMP 34 and the other connected to the output of PWM COMP 35;
7. An NPN transistor Q1 with its base controlled by the output of NOR gate 36.

Operational control circuit 22 enables the switching regulator comprising power stage 20 and pulse width modulator 21 as required to effect the desired operation of the electric door strike. Each operating cycle controlling the unlocking of the strike and the subsequent return of the strike to the locked condition is initiated by the actuation of a momentary switch, S1, S2 or S3. The timing required for the Timed Release modes is effected by means of the timers U1 and U2.

Timers U1 and U2 may be of the type described as a 555 timer on pages 9-3 to 9-8 of Fairchild's 1982 NA Linear data book (copyright 1982 Fairchild Camera and Instrument Corporation, 313 Fairchild Drive, Mountain View, Calif. 94042).

The 555 timer is an integrated circuit described in the data book as "a very stable controller for producing accurate time delays or oscillations. In the time delay mode, the delay time is precisely controlled by one external resistor and one capacitor; . . . By applying a trigger signal, the timing cycle is started and an internal flip-flop is set, immunizing the circuit from any further trigger signals".

During the delay time, the output terminal of the timer is at a positive voltage approaching the supply voltage (Vcc); at the end of the timing period the output falls to very nearly zero volts, depending on the value of current sink. Additional details of 555 timer operation are found in the Fairchild data book referenced earlier.

Timer U1 has its positive supply terminal, Vcc pin 8 connected to +5 V REF REG output 37 and its ground terminal, pin 1 connected to circuit ground 26. Adjustable timing resistor RT1 is connected from pins 6 and 7 to REF REG output 37 and timing capacitor CT1 is connected from pins 6 and 7 to circuit ground 26. Resistors R14 and R16 are serially connected from REF REG output 37 to ground 26 and the junction 38 between these two resistors is connected to the trigger terminal $T_R$ (pin 2 of U1) to bias the trigger terminal to +2.5 V. Momentary switch S1 has one terminal connected to ground 26; the other connected to U1 trigger terminal $T_r$ through a series capacitor, C8. The junction 39 of S1 and C8 is connected to REF REG output 37 through resistor R15. U1 output terminal (pin 3) is connected by series 100 K resistors R9 and R10 to REF REG output 37. An 0.1 μF capacitor C7 is connected from junction 39 to ground 26.

Timer U2 has its Vcc terminal, (pin 8) connected to +5 REF REG output 37. Its reset terminal R (pin 4) is also connected to REF REG output 37 through 47 K resistor R17. A capacitor C11 is connected from U2 pin 4 to ground 26. Ground pin 1 of U2 is connected to ground 26. An adjustable timing resistor RT2 is connected from U2 pins 6 and 7 to REF REG output 37 and a 4.7 μF timing capacitor C 2 is connected from pins 6 and 7 to ground 26. A 47 K resistor, R18 is connected from U2 trigger terminal $T_r$ (pin 2) to REF REG output 37 and momentary switch S2 is connected from pin 2 to ground 26. A capacitor C15 is connected from pin 2 to REF REG output 37. Output terminal 3 of U2 is connected through series 100 K resistors R11 and R13 to REF REG output 37. U2 output pin 3 is connected to the cathode of blocking diode CR3. A resistor R19 is connected to the anode of CR3 and to REF REG output 37. The anode of CR3 connects through C4 to pin 2 of U1.

Pulse width modulator 21 has its positive supply terminal (Vcc), pin 10 connected to the positive dc terminal of BR1. The frequency of OSC 33 is set by timing resistor $R_T3$, connected from pin 6 to ground 26 and timing capacitor $C_T3$, connected from pin 5 to ground 26. Ground pin 7 and deadtime control pin 4 are connected to ground 26. Resistors R3, R4A and R4B form a feed-back divider network connected from the power stage 20 output (VSOL) to ground 26 with the junction of R3, R4A and R4B connected to the non-inverting (+) input of ERR AMP 1. R4B may be disconnected at the installation site to alter the level of the regulated output voltage as needed to match the voltage rating of the solenoid. The inverting (−) input terminal of ERR AMP 1 is connected to +5 V REF REG output 37 by 4.7 K resistor R7 and to timer U1 output pin 3 by 13 K resistor R5. A stabilizing network C5 and R6 is connected from ERR AMP1 inverting input (pin 2) to PWM compensation terminal, pin 3. The non-inverting (+) input terminal (pin 14) of ERR AMP2 is connected to the junction 41 of R11 and R13; the inverting (−) input terminal (pin 13) of ERR AMP 2 is connected to the junction 42 of R9 and R10.

Operation of the electric door strike power and control circuit occurs as follows:

For the Fail Secure/Direct Control mode, switch S1 is not used and junction 39 is connected directly to ground 26. Switch S2 is also unused or not present, and operation is under the control of a normally open momentary switch S3 connected in series with ac or dc supply voltage Vs.

Operation in this mode is shown in FIG. 2 where voltages or states at various points in the circuit are shown for each successive stage of circuit operation. In FIG. 2, each column of voltages and states corresponds to a particular time interval. The first column of values shows voltages and states for the period prior to the closing of S3. The second column shows voltages and states for the period beginning with the closing of S3 and ending with the subsequent opening or release of S3. The third column shows voltages and states following the release of S3.

If S3 is still close when U1 times out, VSOL is removed. This is useful for allowing a strike to be energized for only a fixed time. In this configuration, trigger for U1 is provided at power-up by C7.

With switch S3 open all circuit voltages are at zero volts as indicated by the first column of FIG. 2. Because in the Fail Secure mode the door strike is held in the locked or latched condition by the return spring with no voltage applied to the solenoid, the strike is locked as indicated.

When S3 is closed, voltage is abruptly applied to the circuit and the conditions shown in the second column of FIG. 2 are set. With the trigger input of U1 (junction 39) tied to ground, the output of U1 is switched high as supply voltage is applied to U1 (output approaching +5 V). The output of U2 remains low. Both ends of divider R9/R10 are now at or near +5 V. ERR AMP 2 (−) is thus at +5 V (approx.) while ERR AMP 2 (+) is at +1.7 volts (With junction 39 at ground and U2 output low, junction 41 is set at ⅓ of +5 V by divider R11, R12, R13.) With ERR AMP 2 (−) more positive than ERR AMP 2 (+), the output of ERR AMP 2 (V3) is low. ERR AMP 1 now has complete control of the switching regulator. Solenoid voltage (VSOL) is at the full regulated level and the strike is unlocked. Note that if ERR AMP 2 output is high and more positive than the sawtooth oscillator output present at the negative input of PWM COMP 35, the output of PMM COMP 35 will be high also, causing the output of NOR gate 36 to be low. This condition turns Q1 and thus Q2 OFF for the remainder of the oscillator sawtooth period. Where the output of ERR AMP 2 is low (as in the present condition), ERR AMP 1 has control and controls the PWM duty cycle as appropriate to regulate the output of stage 20 to a voltage level determined by the reference voltage at pin 2 of PWM 21 and feedback divider R3/R4.

When S3 is released (opened) power is removed from the circuit, circuit voltages return to zero and the return spring drives the strike to the locked condition.

For the Fail Secure/Timed Release mode, power is continuously applied. Switch S3 remains closed or not present. Normally open momentary switch S1 is connected as shown in FIG. 1 from junction 39 to ground 26. Switch S2 is unused. Operation in this mode is shown in FIG. 3.

As shown in the first column of values during the period preceding the closing of S1, the outputs of U1 and U2 are at zero volts. Resistors R15, R11, R12 and R13 form a voltage divider between the +5 V output 37 of REF REG 32 and ground which sets the voltage at junction 41 and (ERR AMP 2) non-inverting or positive input at approximately 3.1 volts. Resistors R9 and R10 form a voltage divider which sets the voltage at junction 42 (and the inverting or negative input of ERR AMP 2) to 2.5 volts. With the non-inverting input of ERR AMP 2 being more positive than the inverting input, ERR AMP 2 output is high causing Q1 and Q2 to be turned off. Power stage output (VSOL) is thus at zero volts and the strike is locked.

When S1 is depressed (closed), R12 is pulled to ground (0 volts) and the voltage at the non-inverting input of ERR AMP 2 drops to 1.7 volts. At the same time, C8 couples a negative pulse to the trigger input ($T_r$) of U1. U1 responds as the trigger input drops below ⅓ the supply voltage (1.67 volts in this case). The output of U1 now switches to high (approaching +5 V). This takes both ends of R9/R10 voltage divider high, setting the inverting input of ERR AMP 2 to approximately +5 volts. With its inverting input more positive than its non-inverting input, ERR AMP 2 output goes low, allowing ERR AMP 1 to control the output of power stage 20. U1 has also placed both ends of the R5/R7 voltage divider at or near +5 volts. The output of power stage 20 is thus commanded to the full pull-in voltage for proper operation. The solenoid now drives the strike to the unlocked position.

The output of U1 remains high for a period of time equal to $1.1 \times R_T1 \times C_T1$ which may be set at the desired value, typically between two and seven seconds.

At the end of the set period, the output of U1 returns low. If S1 has been released (opened), initial conditions are restored and power is removed from the strike. If S1 is still closed, the voltage at the inverting input of ERR AMP 2 returns to 2.5 volts. This is still greater than the 1.7 volts at the non-inverting input, so ERR AMP 1 retains control. With the output of U1 low, R5 and R7 set the voltage at the reference input (inverting input) of ERR AMP 1 to 3.75 volts, reducing the output of power stage 20 to the holding voltage. Releasing S1 now restores initial conditions, removing power from the strike, allowing the spring to return the strike to the locked condition.

Operation under Fail Safe/Direct Control is illustrated in FIG. 4. Junction 39 is tied to ground 26 as in the case of Fail Secure/Direct Control. Input power is supplied through a normally closed momentary switch S3. The outputs of U1 and U2 are low. The ERR AMP 2 inverting input is at 2.5 volts and the non-inverting input is at 1.7 volts causing ERR AMP 2 output to be low. ERR AMP 1 is thus in control and regulating output voltage, VSOL, to the holding voltage. For Fail Safe the strike is locked or latched when the solenoid is energized. The strike is thus held in the locked condition.

When S3 is depressed (opened), power is removed from the circuit and from the strike as shown in the second column of values of FIG. 4. With power removed, the return spring drives the strike to the unlocked condition.

When S3 is subsequently released (closed), power is restored to the circuit. With U1's trigger, $T_R$, clamped to ground via C7, the output of U1 goes high as supply voltage rises. When the output of U1 goes high, both ends of the R9/R10 divider go high and the inverting input of ERR AMP 2 goes to 5 volts (more positive than the non-inverting input), and the output of ERR AMP 2 goes low, yielding control of the regulation loop to ERR AMP 1. While the output of U1 is high, the reference voltage at the inverting input of ERR AMP 1 is high and full pull-in voltage is delivered to the solenoid. The strike is thus driven by the solenoid to the locked condition.

The output of U1 remains high for a period equal to $1.1\times R_T1\times C_T1$ holding VSOL to the full pull-in voltage. At the end of this period, the output of U1 falls to 0 volts, causing V5 to drop to 3.75 volts. This, in turn, causes the power stage output, VSOL to drop to the hold-in voltage. The strike now remains in the locked condition until the next operation of S3.

Operation under Fail Safe/Timed Release is illustrated in FIG. 5. For this mode of operation, power is continuously applied. Switch S3 is not present or is shorted out. Junction 39 is connected to ground 26 and operation is controlled by means of normally open momentary switch S2. The outputs of U1 and U2 are low as shown in the first column of values of FIG. 5. The inverting and non-inverting input terminals of ERR AMP 2 are at 2.5 volts and 1.7 volts, respectively, causing the output of ERR AMP 2 to be low and yielding control of the power stage to ERR AMP 1. With the output of U1 low, the power stage is at the holding level and the strike is locked.

A momentary closure of S2 triggers U2 causing the output of U2 to go high, initiating conditions shown in the second column of values of FIG. 5. The inverting and non-inverting inputs of ERR AMP 2 are at 2.5 volts and 3.3 volts, respectively. With the non-inverting input higher than the inverting input, ERR AMP 2 output goes high, taking control from ERR AMP 1 and turning off the power stage output. As voltage is thus removed from the solenoid, the return spring unlocks the strike.

The output of U2 remains high for a period of time equal to $1.1\times R_T2\times C_T2$. At the end of this period, the output of U2 falls to zero. If S2 is still closed, the trigger input $T_r$ of U2 is still low and the output of U2 remains high. The solenoid voltage remains at zero volts and the strike remains unlocked until S2 is released.

If S2 has opened at the end of the U2 time-out period, or at the time S2 is opened subsequent to time-out, the output of U2 falls to zero. This returns the non-inverting input of ERR AMP 2 to 1.7 v and control output voltage is yielded to ERR AMP 1.

The falling edge of U2's output triggers U1 via C14 and CR4 causing the output of U1 to go high. Conditions are now set as shown in the third column of values of FIG. 5.

With the inverting input higher than its non-inverting input, ERR AMP 2's output is low and ERR AMP 1 regulates output voltage. As long as the output of U1 remains high, the power stage output is regulated to the full pull-in voltage, energizing the solenoid and locking the strike. At the end of the U1 time-out period ($1.1\times R_T1\times C_T1$) the output of U1 falls to zero volts, taking V5 to 3.75 volts and causing the power stage output to be regulated to the reduced holding voltage.

The strike remains in the locked condition until the next operation of S2.

The electric door strike power and control circuit of the invention has been shown to be readily adaptable for operation in each of the four operating modes as illustrated in FIGS. 2–5. As these operating modes are considered, the following control characteristics may be noted:

For Fail Secure modes, the strike is locked when solenoid is not energized; for Fail Safe modes the strike is unlocked when the solenoid is not energized.

For Direct Control modes the unlocking operations are initiated and controlled by S3 which is normally open for Fail Secure and normally closed for Fail Safe.

For Fail Secure/Timed Release the unlocking operation is initiated by normally open momentary switch S1 and for Fail Safe/Timed Release the unlocking operation is initiated by normally open momentary switch S2.

Timer U1 controls the duration of the unlocked period for Fail Secure/Timed Release; timer U2 controls the duration of the unlocked period for Fail Safe/Timed Release.

For Fail Safe operating modes, full output (or pull-in) voltage is first applied to the solenoid as the strike is returned to the locked condition. The solenoid voltage is then reduced to a lower hold-in voltage to prevent over-heating of the solenoid and power stage 20 during the long periods of time between unlocked intervals.

The state of U1 determines the level of voltage delivered to the solenoid. When the output of U1 is high, full output or holding voltage is supplied; when the output of U1 is low, the reduced holding voltage is applied for the duration of the full output or pull-in.

The time-out periods of U1 and U2 are readily adjustable at the installation site as appropriate for the intended operating mode. Switches S1, S2 and S3 are external to the door strike assembly. For these reasons, a standard power and control circuit suffices for all four operating modes.

A versatile, adaptable and efficient power and control circuit is thus provided in accordance with the stated objects of the invention, and while the specifics of the circuit have been defined in great detail, various changes and modifications of the circuit involving interconnections between the integrated circuits, U1, U2 and the pulse width modulator 21, addition of noise suppression capacitors or resistance value changes may become apparent to those skilled in the art. These and other changes and modifications may be made without departing from the spirit of the invention or from the scope of the appended claims.

What is claimed is:

1. A power and control circuit for a solenoid driven electric door strike comprising:

a power stage including an input rectifier, a pass transistor and an LC filter;

a pulse width modulator;

first and second electronic timer circuits;

means for connecting said circuit to an external ac or dc power source;

means for connecting an external switch to one of three control locations within said power and control circuit;

whereby the desired mode of operation for a particular installation of the strike is obtained by wiring the external switch to the appropriate control location and by the selection of a normally open or a normally closed switch as required for the desired operating mode; and interconnecting means between said power stage, said pulse width modulator and said first and second electronic timer circuits;

whereby when said external switch is actuated to initiate or control the unlocking of the door strike for a desired period of time after which the strike is returned automatically to the locked condition, said timer circuits enabling or disabling the operation of said pulse width modulator and said pulse width modulator controlling said pass transistor of said power stage to set the output of said power stage to zero or to one of two desired output levels as appropriate for the successive stages of operation and for the intended operating mode.

2. The power and control circuit of claim 1 wherein a normally open momentary external switch is connected to trigger said second electronic timer circuit for operation in a Fail Safe/Timed Delay mode.

3. The power and control circuit of claim 2 wherein said second electronic timer circuit controls the duration of the timer period over which the strike remains unlocked following the actuation of said external switch and wherein said first electronic timer circuit controls the time period over which the voltage delivered to a solenoid of the strike is held at the full output or pull-in voltage when voltage is reapplied to the solenoid of the strike following the unlocked period.

4. The power and control circuit of claim 2 wherein said first electronic timer circuit controls the duration of the time period over which the output voltage delivered to a solenoid of the strike is held at the full output or pull-in voltage when voltage is reapplied to the solenoid .of the strike following the unlocked period.

5. The power and control circuit of claim 1 wherein an external normally open momentary switch is connected to trigger said first electronic timer circuit for operation in a Fail Secure/Timed Delay mode.

6. The power and control circuit of claim 5 wherein said first electronic timer circuit controls the duration of the time period over which the strike remains unlocked following the actuation of said external switch.

7. The power and control circuit of claim 1 wherein a normally closed external switch is connected in series with said external ac or dc power source for operation in a Fail Safe/Direct Control mode.

8. The power and control circuit of claim 1 wherein a normally open external switch is connected in series with said external ac or dc power source for operation in a Fail Secure/Direct Control mode.

9. The power and control circuit of claim 1 wherein the delay times of said first and second electronic timer circuits are individually adjustable on site as appropriate for a given installation or operating mode.

10. The power and control circuit of claim 1 in further combination with means for setting the level of the output voltage delivered to a solenoid of the strike at one of two or more levels.

* * * * *